US006196476B1

(12) United States Patent
Wang

(10) Patent No.: US 6,196,476 B1
(45) Date of Patent: Mar. 6, 2001

(54) DISPENSER HEAD FOR GARDEN WATERING SPRINKLER

(75) Inventor: King-Yuan Wang, Changhua Hsien (TW)

(73) Assignee: Yuan Mei Corporation, Changhua Hsien (TW)

( * ) Notice: Subject to any disclaimer, the term of this patent is extended or adjusted under 35 U.S.C. 154(b) by 0 days.

(21) Appl. No.: 09/525,769

(22) Filed: Mar. 14, 2000

(51) Int. Cl.[7] ..... B05B 1/16
(52) U.S. Cl. ..... 239/394; 239/446
(58) Field of Search ..... 239/394, 392, 239/391, 442, 446, 525, 526, 540, 106

(56) References Cited

U.S. PATENT DOCUMENTS 5,566,886 * 10/1996 Wang ..... 239/394
5,598,978 * 2/1997 Wang ..... 239/394
5,645,222 * 7/1997 Chih ..... 239/394
5,772,121 * 6/1998 Wang ..... 239/394
5,873,531 * 2/1999 Wang ..... 239/394
5,992,762 * 11/1999 Wang ..... 239/394

* cited by examiner

*Primary Examiner*—Lesley D Morris

(74) *Attorney, Agent, or Firm*—Bacon & Thomas, PLLC

(57) ABSTRACT

An improved dispenser head structure for a garden watering sprinkler is integrally combined with a base plate by ultrasonic welding. The dispenser head is secured to the head portion of a sprinkler gun by a screw. The dispenser head is provided with a plurality of radially distributed full discharge openings on the periphery thereof. The dispenser head has a round board on which are equipped with 4 discharge outlets at the central area thereof. A ring area disposed adjacent to those peripherally located full discharge openings is provided with a plurality of bores. A round area is disposed at the center area circled by the 4 discharge outlets. There are a small C-shaped partition wall area and a large C-shaped partition wall area on the rear side of the round board, that are continually connected to the tubular extension of the 4 discharge outlets by vertical walls so that a closed area is defined at the center thereof. There are 6 inlet holes and 4 full discharge outlets on the base plate. The 6 inlet holes are registered with the 4 tubular extensions and the small and large C-shaped partition wall areas. Water can be filled up the closed area via the large C-shaped partition wall area and discharged via the multiple full discharge openings when the dispenser head is rotated to make the large C-shaped partition wall area selectively registered with a water discharge hole. Such a dispenser head permit a reverse flow of water externally jetted against the dispenser head to clean dirt accumulated in the dispenser head. The removed dirt can be brought out of dispenser head via the full discharge openings.

1 Claim, 8 Drawing Sheets

DISPENSER HEAD FOR GARDEN WATERING SPRINKLER

BACKGROUND OF THE INVENTION

The present invention relates to an improved dispenser head structure for a garden watering sprinkler. The dispenser head is integrally combined with a base plate by ultrasonic welding method. The dispenser head is secured to the head portion of a sprinkler gun by a screw. The dispenser head is provided with a plurality of radially distributed full discharge openings on the periphery thereof. The dispenser head has a round board on which are equipped with 4 discharge outlets at the central area thereof. A ring area disposed adjacent to those peripherally located full discharge openings is provided with a plurality of bores. A round area is disposed at the center area circled by the 4 discharge outlets. There are a small C-shaped partition wall area and a large C-shaped partition wall area on the rear side of the round board, that are continually connected to the tubular extension of the 4 discharge outlets by vertical walls so that a closed area is defined at the center thereof. There are 6 inlet holes and 4 full discharge outlets on the base plate. The 6 inlet holes are registered with the 4 tubular extensions and the small and large C-shaped partition wall areas. Water can be filled up the closed area via the large C-shaped partition wall area and discharged via the multiple full discharge openings when the dispenser head is rotated to make the large C-shaped partition wall area selectively registered with a water discharge hole. Such a dispenser head permit a reverse flow of water externally jetted against the dispenser head to clean dirt accumulated in the dispenser head. The removed dirt can be brought out of dispenser head via the full discharge openings.

Referring to FIG. 1, the exploded components of the prior art comprises a sprinkler gun 10, a seal ring 14, a positioning pin 16, a screw 17, a dispenser head 20 and a base plate 30. The sprinkler gun 10 has a head portion 11 provided with an internally threaded post 12. Right above the internally threaded post 12 is disposed a water discharge hole 13 in which are disposed a number of axially defined ribs 131. A positioning hole 15 is placed at a distance under the water discharge hole 13. The dispenser head 20 is has a plurality of inwardly and radially tapered ribs 21 connected to a round board 22 full of discharge bores. Between every two ribs 21 is defined a full discharge opening 25. There are 6 variation discharge outlets 23 and 2 closed circular areas 24, as shown in FIG. 2. Each discharge outlet 23 has a backwardly defined tubular extension 26. There are 6 inlet holes 31, a finely netted water inlet hole 32, a key hole shaped cavity 33 disposed on the base plate 30 on the rear side of which are disposed 8 retaining recesses 34.

In assembly, as shown in FIG. 3, the base plate 30 and the dispenser head 20 are integrally fixed together by an ultrasonic welding method with the 6 inlet holes 31 of the base plate 30 registered with the 6 tubular extensions 26. The peripheral flange wall 35 is placed at a distance with the inner wall of the dispenser head 20. The positioning pin 16 is housed in the positioning hole 15 and a seal ring 14 is placed in the water discharge hole 13 of the head portion 11 of the sprinkler gun 10. The dispenser head 20 is secured to the head portion 11 of the sprinkler head 10 by a screw 17 which is engaged with the central hole of the dispenser head 20 and the base plate 30 and the internally threaded post 12. The inlet holes 31 of the base plate 30 are rotated into selective registration with the water discharge hole 13 and retained in place by the positioning pin 16 which is selectively registered with one of the retaining recesses 34.

When one of the inlet holes 31 of the base plate 30 is selectively registered with the water discharge hole 13, water can be discharged out of one of the variation discharge outlets 23. Alternatively, the finely netted water inlet hole 32 registered with the closed circular area 24 is engaged with the water discharge hole 13, water can be discharged via the bored ring area of the round board 22 of the dispenser head 20. As further shown in FIG. 4, when the water discharge hole 13 is placed in alignment with the key hole shaped cavity 33 of the base plate 30, water can be led into the space between the peripheral wall 35 and the inner wall of the dispenser head 20. Thereby water can be discharged out of the full discharge openings 25 among the ribs 21 of the dispenser head 20.

To clean accumulated dirt out of the garden watering sprinkler of the prior art, external water flow is jetted against the dispenser head 20 so that water can be led into the full discharge openings 25, all other variation discharge outlets 23 and all dirt is flushed into the inlet holes 31 of the base plate 30 and also the netted inlet hole 32. Finally, the removed dirt is brought into the sprinkler gun 10 and expelled out via the full discharge openings 25.

The prior dispenser head 20 has the following disadvantages in use:

1. When water is discharged out of the full discharge openings 25, the key hole shaped cavity 33 of the base plate 30 is registered with the water discharge hole 13 of the head portion 11 of the sprinkler gun 10. In that case, water is limited and easily concentrated in the full discharge openings at lower portion of the dispenser head 20.
2. The externally jetted water flow is easily limited by the key hole shaped cavity 33 when dirt of the dispenser head 20 is to be cleaned, so it is relatively hard to get the dispenser head precisely and completely cleaned.

SUMMARY OF THE INVENTION

Therefore, the primary object of the present invention is to provide an improved dispenser head for a garden watering sprinkler which is equipped with a large and a small C-shaped partition wall area that define a closed area in combination with a continuous wall. The closed area is registered with a number of full discharge outlets of a base plate which is fixedly secured to the dispenser head so that water can be evenly distributed and discharged via a plurality of full discharge openings evenly disposed around the periphery of the dispenser head. Such a structure permits water to be discharged in a smoother and more distributive manner without concentration at a particular area.

Another object of the present invention is to provide a dispenser head for a garden watering sprinkler which can be cleaned directly by a reverse flow of water jetted against the central area of a round board of the dispenser head. Dirt accumulated in the dispenser is flushed into a closed area of the dispenser and then into a plurality of full discharge outlets of the base plate. Thereby dirt is finally driven out the dispenser head via a plurality of full discharge openings disposed around the periphery of the dispenser head in a more direct and complete manner.

DETAILED DESCRIPTION OF THE PREFERRED EMBODIMENTS

Figure 1:
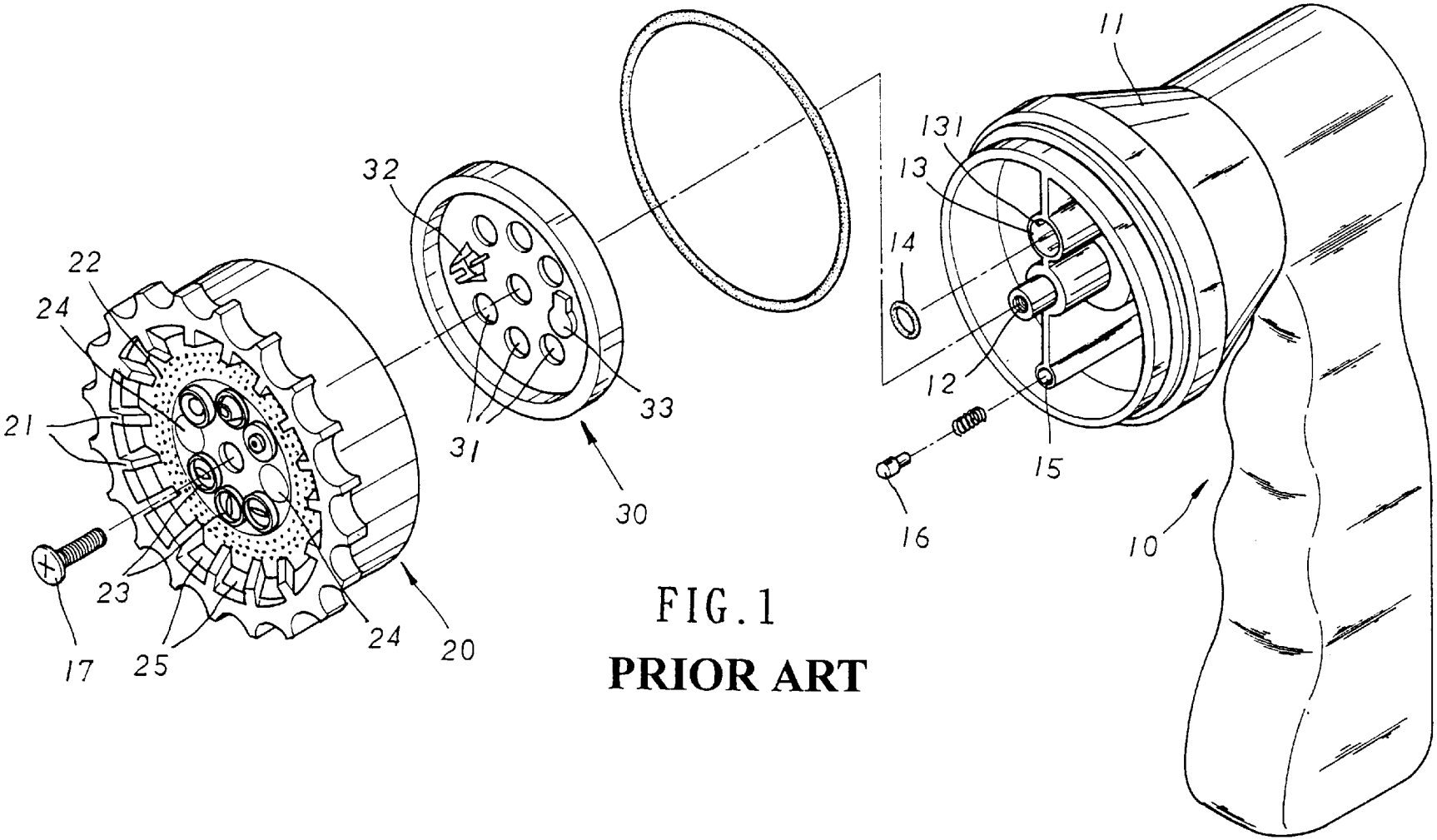
FIG. 1 PRIOR ART
FIG. 1 is a perspective diagram showing the exploded components of a prior garden watering sprinkler.
Figure 2:
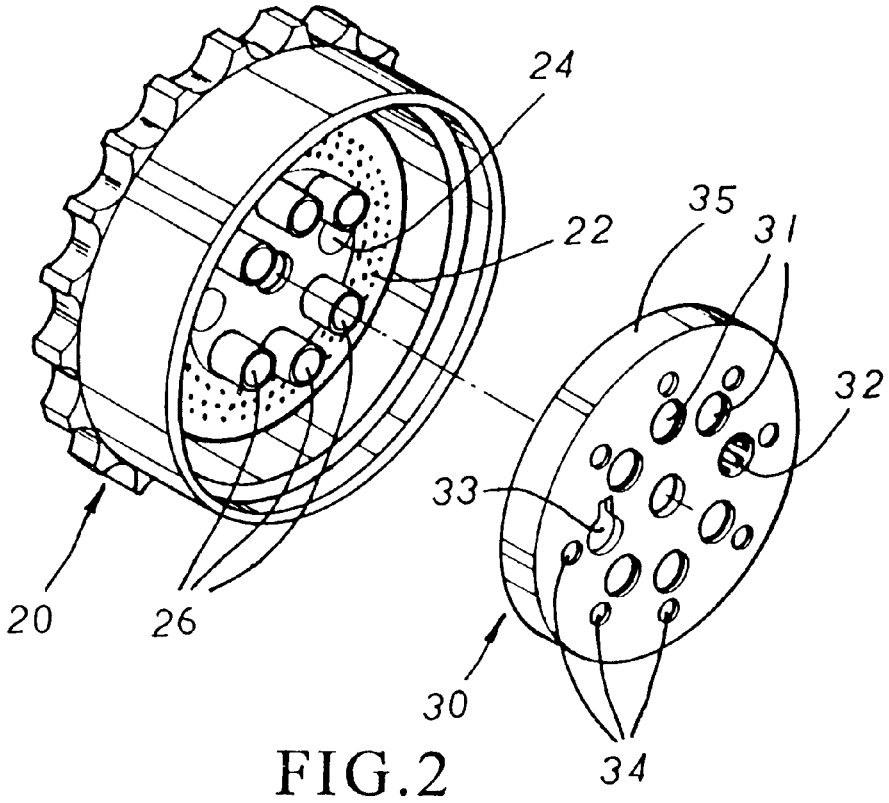
FIG.2 PRIOR ART
FIG. 2 is a perspective diagram showing the dispenser head and a reversely placed base plate of the prior garden watering sprinkler.
Figure 3:
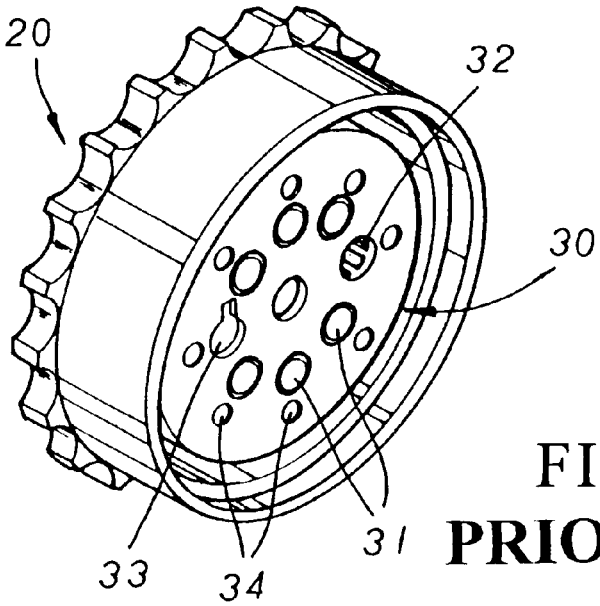
FIG.3 PRIOR ART
FIG. 3 is a perspective diagram showing the assembly of the prior dispenser head and base plate.
Figure 4:
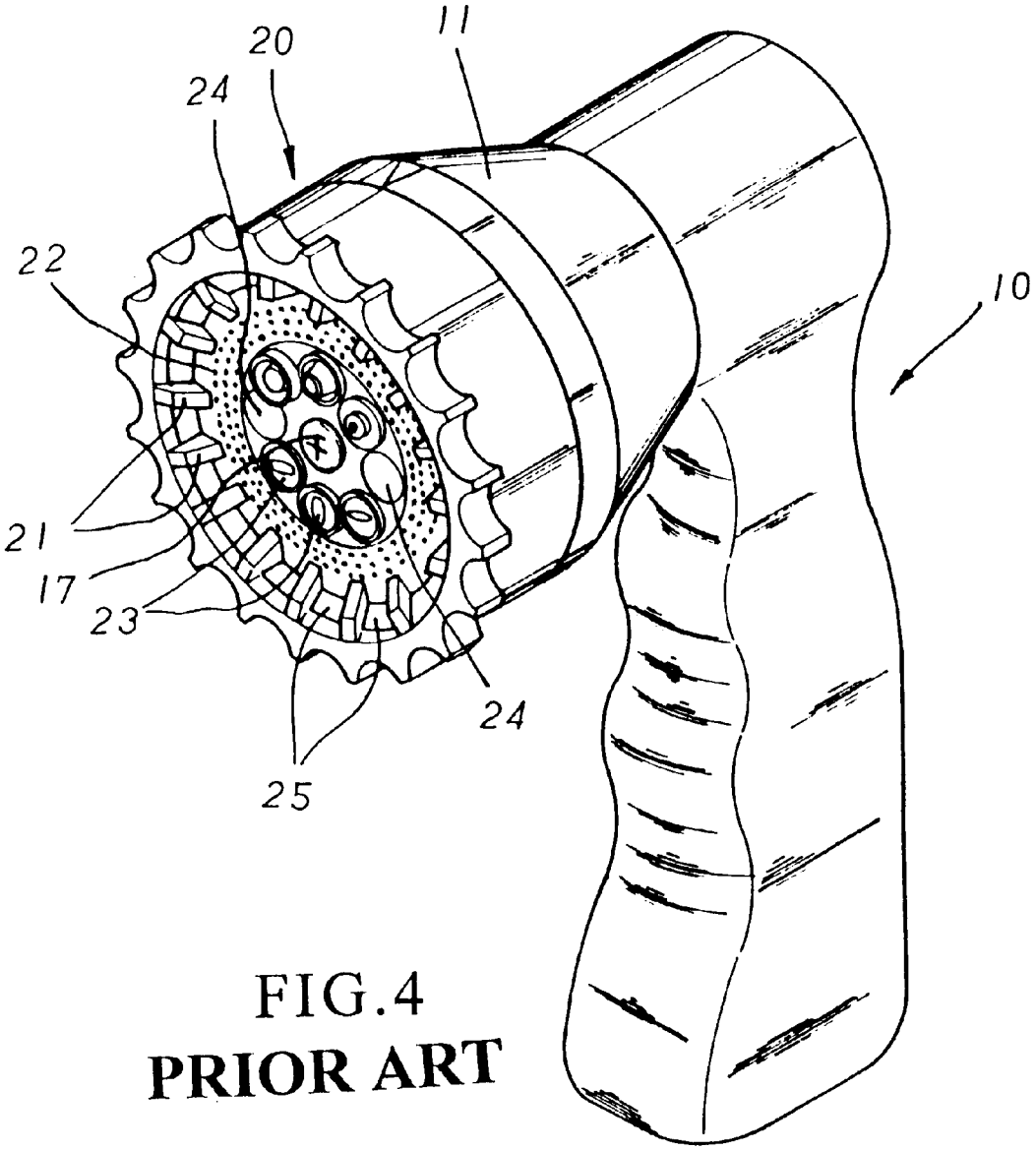
FIG.4 PRIOR ART
FIG. 4 is a perspective diagram showing the assembly of the prior watering sprinkler.
Figure 5:
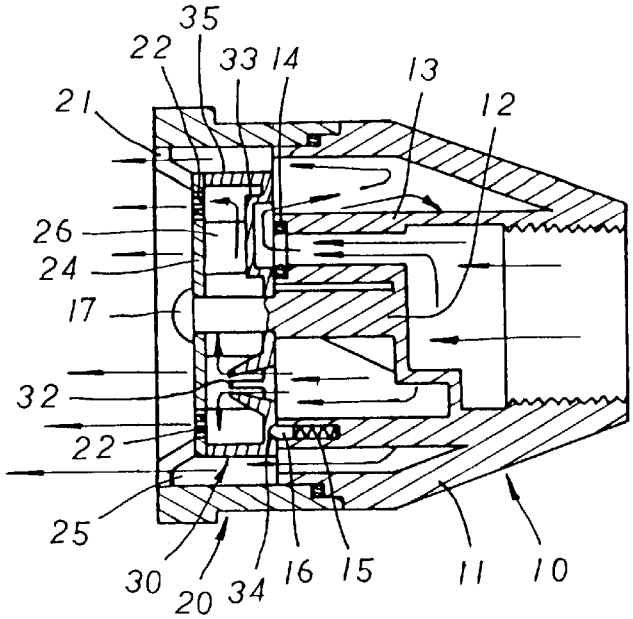
FIG.5 PRIOR ART
FIG. 5 is a sectional diagram showing a full discharge operation mode of the prior dispenser head.
Figure 6:
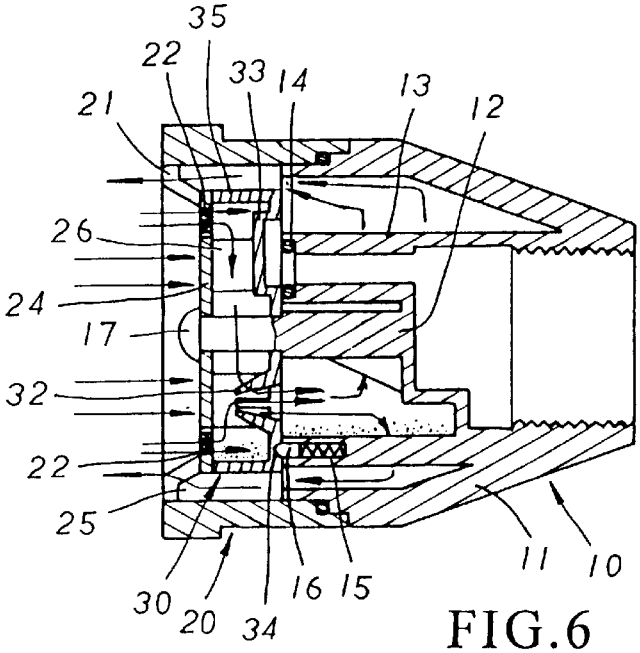
FIG.6 PRIOR ART
FIG. 6 is a sectional diagram showing the cleaning mode of a prior dispenser head.
Figures 7, 7A:
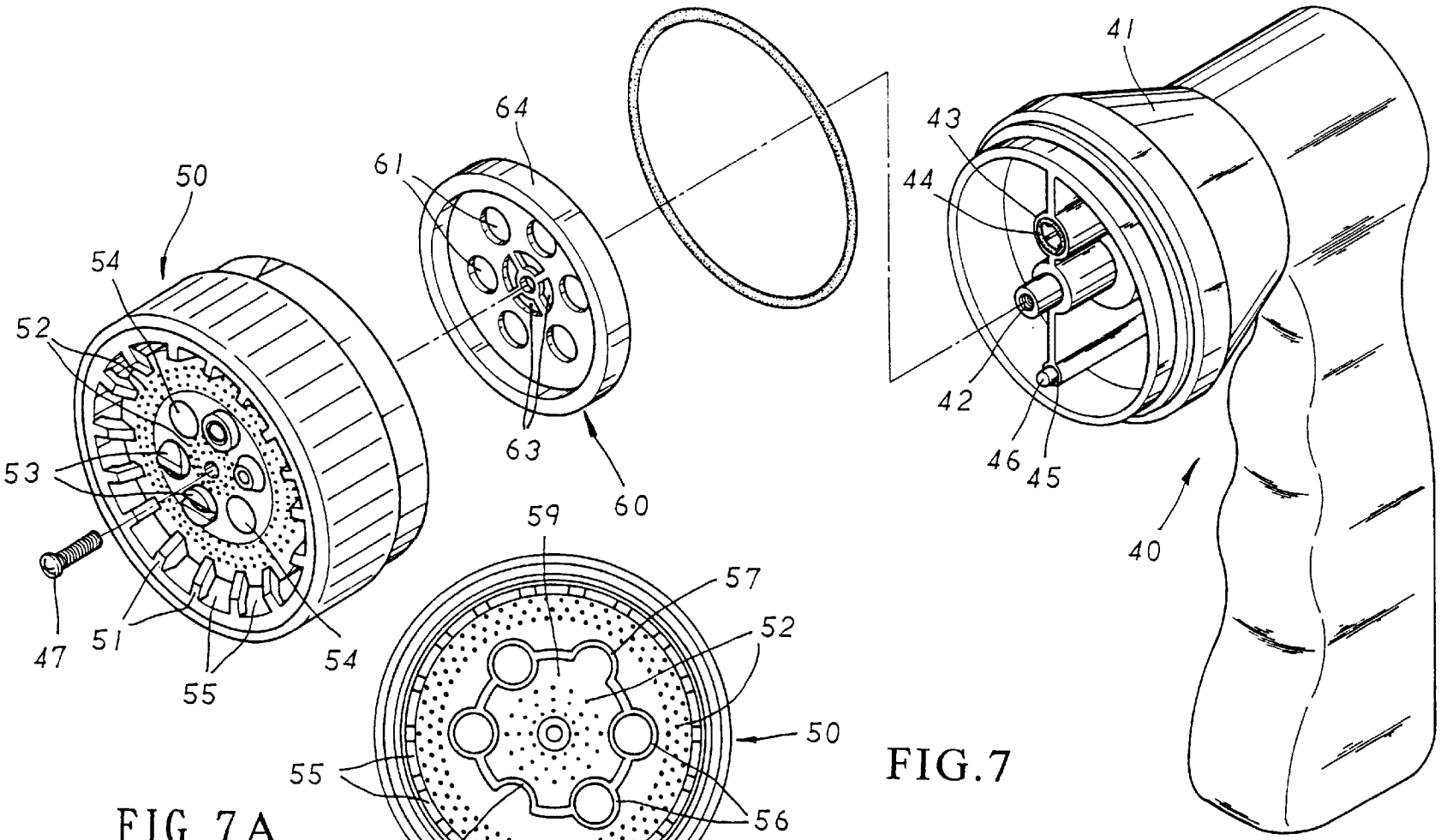
FIG. 7 is a perspective diagram showing the exploded components of the present invention.
FIG. 7A is a rear plane view of the dispenser head.
Figure 8:
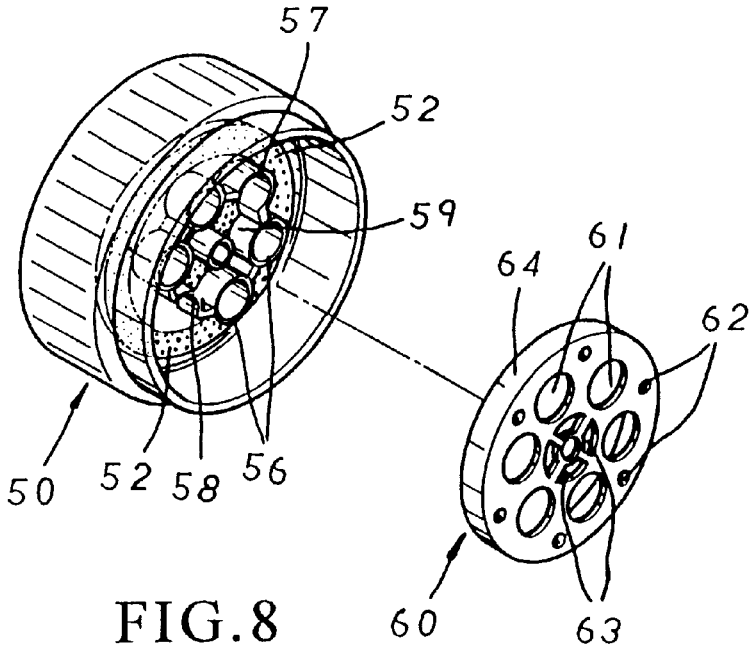
FIG. 8 is a perspective diagram showing the dispenser head and the rear side of the base plate.

Referring to FIGS. 7, 7A, the improved watering sprinkler of the present invention has a sprinkler gun 40, a seal ring 44, a spring biased positioning pin 46, a screw 47, a dispenser head 50 and a base plate 60. The sprinkler gun 40 has a head portion 41 which is equipped with an internally threaded post 42 at the center thereof. Right above the internally threaded post 42 is disposed a water discharge hole 43 at the outlet of which is disposed an O-shaped seal ring 44. At a distance below the post 42 is disposed the spring biased positioning pin 46. The dispenser head 50 has an internal periphery full of evenly and radially distributed connection ribs 51 that terminate in a round board 52 full of sprinkling bores. Between every two connection ribs 51 is defined a full discharge opening 55. In the central area of the round board 52 are disposed 4 variously shaped discharge outlets 53 and two symmetrically located closed circles 54 as shown in FIG. 8.

From each of the variously shaped discharge outlets 53 extends a tubular post 56 and at the rear side of one closed circle 54 is disposed an internally oriented large C-shaped partition wall area 57 and at the rear side of the other closed circle 54 is disposed an externally oriented small C-shaped partition wall area 58. Thereby a closed area 59 is defined among the 4 tubular posts 56 and the large and small C-shaped partition wall 57, 58 by continuous raised walls.

There are 6 water inlet holes 61 defined on the base plate 60. On the rear side of the base plate 60 are disposed 6 retaining cavities 62 disposed adjacent each corresponding inlet hole 61. There are 4 full discharge outlets 63 disposed at the center of the base plate 60.

Figure 9:
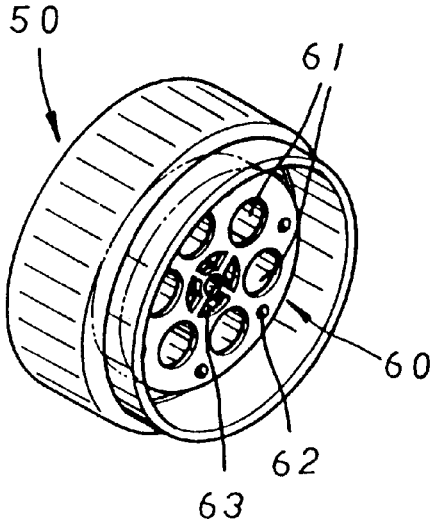
FIG. 9 is a diagram showing the assembly of the dispenser head.

Referring to FIG. 9, in assembly, the base plate 60 is placed inside the dispenser head 50 from the open end of the dispenser head 50 with the inlet holes 61 of the base plate 60 aligned and registered with the tubular posts 56 and the closed circular areas 54 registered with the large and small C-shaped partition wall areas 57, 58 of the dispenser head 50. The base plate 60 has a flanged wall 64 on the periphery thereof which is placed at a little distance from the connection ribs 51 of the dispenser head 50 and then is integrally fixed in place by way of ultrasonic welding.

Figure 10:
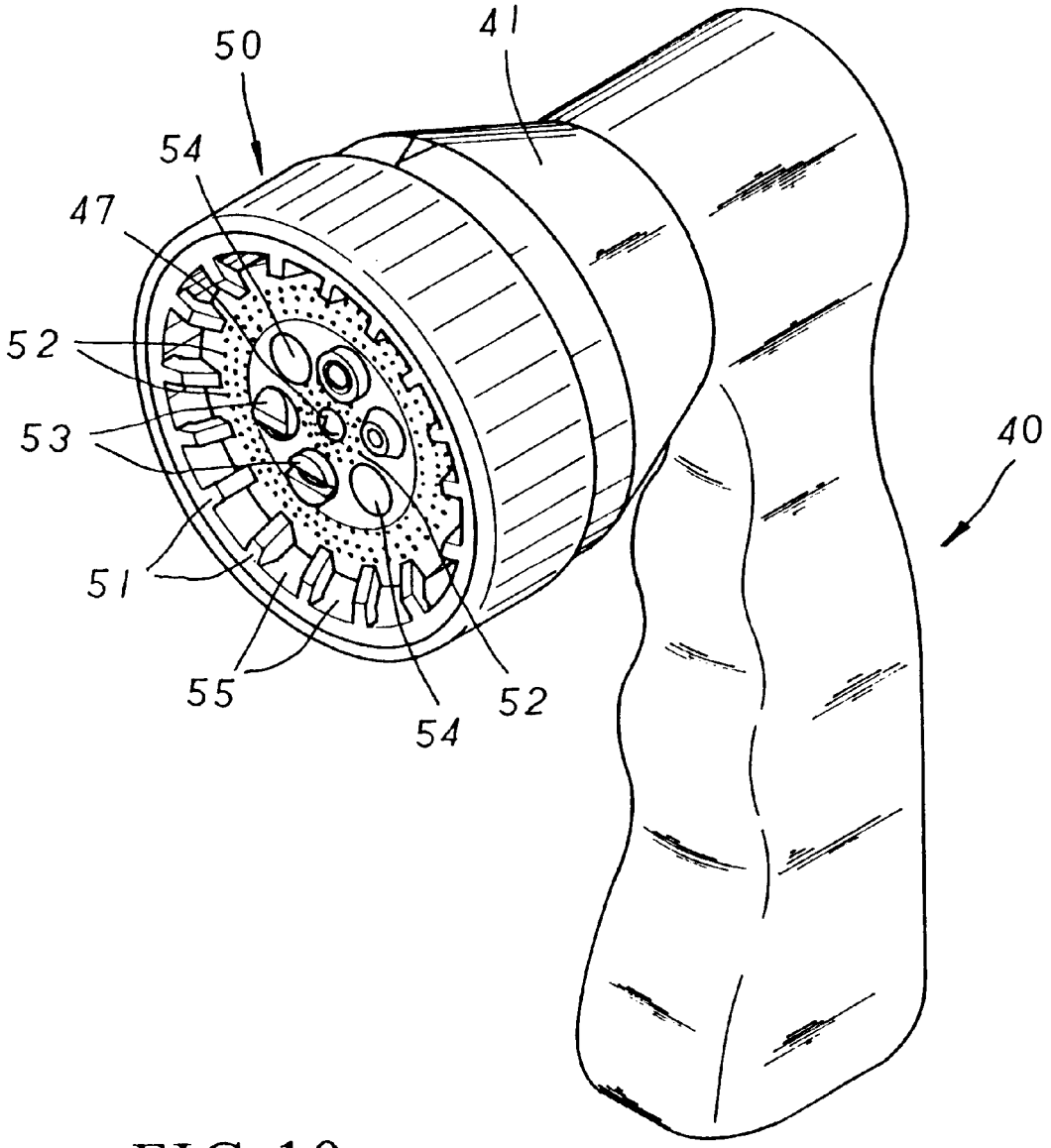
FIG. 10 is a perspective diagram showing the assembly of the watering sprinkler of the present invention.

Referring to FIG. 10, the dispenser head 50 in combination with the base plate 60 is secured to the head portion 41 of the sprinkler gun 40 by way of a screw 47 which is led through a central hole of the dispenser head 50 and engaged with the internally threaded post 42 of the head portion 41 of the sprinkler gun 40. The spring biased positioning pin 46 can be selectively engaged with the retaining cavities 62 on the reverse side of the base plate 60 so as to lock the rotatable base plate 60 in combination With the dispenser head 50 in place when the dispenser head 50 is rotated to make one of the inlet holes 61 registered with the water discharge hole 43. The O-shaped seal ring 44 can make water effectively flowing and discharged via the dispenser head 50 without leakage.

As the dispenser head 50 is rotated to make one of the inlet holes 61 of the base plate 60 registered with the water discharge hole 43 of the sprinkler gun 40, then water can be discharged out of one of the 4 discharge outlets 53 of the dispenser head 50. Alternatively, the dispenser head 50 can be rotated to allow the small C-shaped partition wall area 58 to register with one of the inlet hole 61 of the base plate 60, which aligns with the water discharge hole 43 of the head portion 41 of the sprinkler gun 40 so that water can be sprinkled via the sprinkling bores defined on the peripheral ring area of the round board 52.

Figure 11:
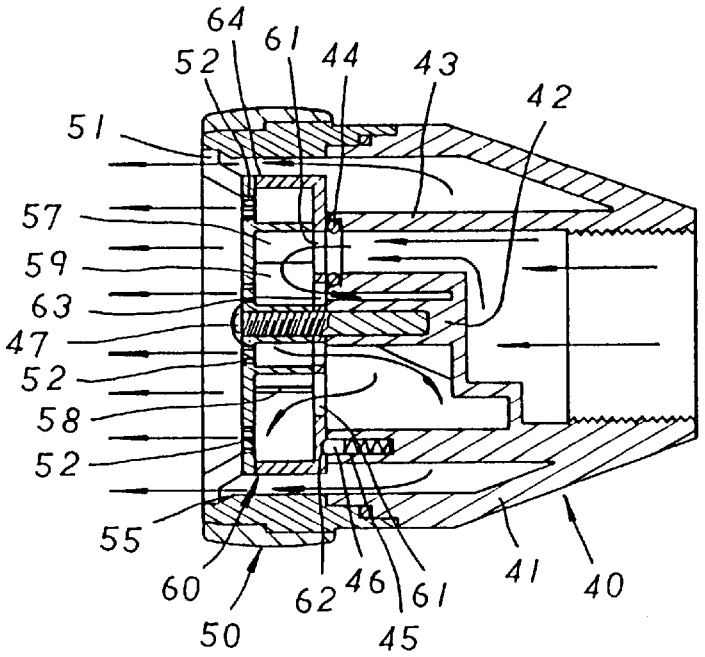
FIG. 11 is a sectional diagram showing the full discharge operation mode of the present invention.

Referring to FIG. 11, it is a sectional diagram showing water being discharged via the full discharge openings 55 of the dispenser head 50. In that case, the dispenser head 50 is rotated to make the inlet hole 61 of the base plate 60 in registration with the large C-shaped partition wall area 57 of the dispenser head 50 engaged with the water discharge hole 43 of the head portion 41 of the sprinkler gun 40, at then water is discharged via the central area of the dispenser head 50 in small amount and large amount of water rushes into and fills up the closed area 59 of the dispenser head 50. As a result, water flows via the full discharge outlets 63 defined at the central area of the base plate 60 into the space of the dispenser head 50 and further is evenly discharged via the full discharge openings 55 and all the sprinkling bores of the round board 52.

Figure 12:
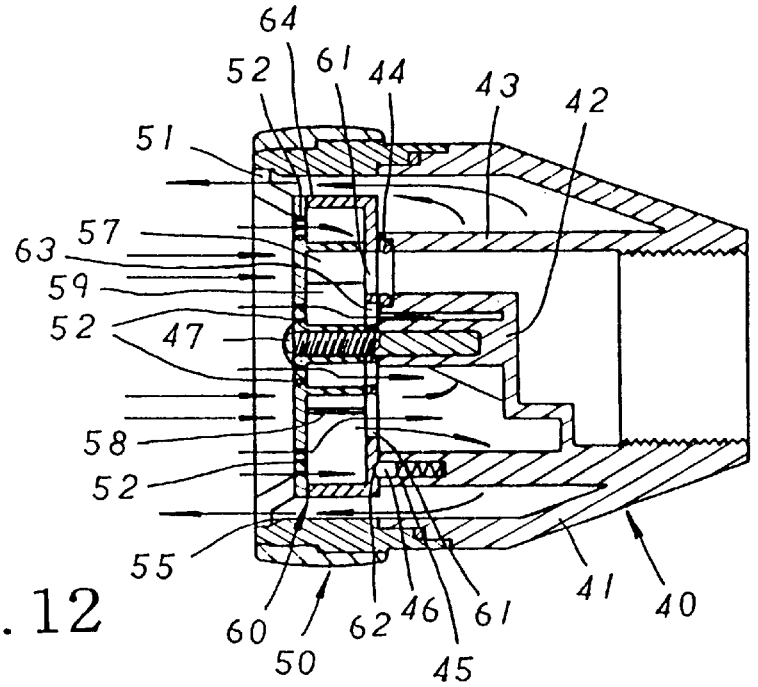
FIG. 12 is a sectional diagram showing another operation mode of the present invention to clean the dispenser head.

To clean dirt out of the dispenser head 50, as shown in FIG. 12, reverse water flow is directly jetted against the dispenser head 50 so that such a water flow rushes via the full discharging openings 55, all the central sprinkling bores and the 4 discharge outlets 53 of the round board 52 into the closed area 59 of the dispenser head 50 with dirt flushed into the closed area 59 accordingly. Then the reverse water is led via the full discharge outlets 63 of the base board 60 to the interior of the sprinkler gun 40 and further to the full discharge openings 55 of the dispenser head 50.

It can be apparently seen that there are following advantages associated with the present invention:

1. Water can be evenly distributed and discharged out of the multiple full discharge openings 55 of the dispenser head 50 via the full discharge outlets 63 of the base plate 60 as a result water is guided into the closed area 59 via the large C-shaped partition wall area 57 of the dispenser head 50 when one of the inlet holes 61 of the base plate 60 registered with the large C-shaped partition wall area 57 of the dispenser head 50.
2. Dirt accumulated in the dispenser head 50 can be cleaned by a reverse flow of water which is jetted against the central area of the round board 52 of the dispenser head 50. So, dirt can be flushed into the closed area 59 of the dispenser and further via the full discharge outlets 63 of the base plate 60 and finally discharged out of the full discharge openings 55 of the sprinkler gun 40. Thus, the dispenser head 50 can be more directly and completely cleaned by a reverse flow of water, allowing the same to be normally operated all the time.

I claim:

1. An improved garden watering sprinkler having a sprinkler gun to which is secured a dispenser head and a base plate that are combined with each other by way of ultrasonic welding; said sprinkler gun having a water discharge hole and a positioning hole in which a spring is housed; an O-shaped seal ring being disposed in said water discharge hole; a positioning pin being located in said positioning hole; said dispenser head having an internal periphery full of evenly and radially distributed connection ribs that terminate in a round board full of sprinkling bores; between every two connection ribs being defined a full discharge opening; in a central area of said round board being disposed 4 variously structured discharge outlets and two symmetrically located closed circular areas; from each of said variously structured discharge outlets extends a tubular post; on said base plate being disposed a plurality of inlet holes and on a rear side of said base plate being disposed a plurality of retaining cavities corresponding in number to said inlet holes; wherein:

at the rear side of one closed circular area is disposed an internally oriented large C-shaped partition wall area and at the rear side of the other closed circular area is disposed an externally oriented small C-shaped partition wall area; thereby a closed area is defined among said tubular posts of said 4 discharge outlets and said large and small C-shaped partition wall by continuous raised walls; there are 6 water inlet holes defined on said base plate; on the rear side of said base plate are disposed 6 retaining cavities disposed adjacent each corresponding inlet hole; said base plate is placed inside the dispenser head from the open end of said dispenser head with said inlet holes of said base plate aligned and registered with said tubular posts and said closed circular areas registered with said large and small C-shaped partition wall areas of said dispenser head; said base plate has a flanged wall on a periphery thereof which is placed at a little distance from the connection ribs of said dispenser head; as said dispenser head is rotated to make one of said inlet holes of said base plate in registration with the large C-shaped partition wall area of said dispenser head engaged with said water discharge hole of said head portion of said sprinkler gun; at then water is discharged via the central area of said dispenser head in small amount and large amount of water rushes into and fills up said closed area of the dispenser head; as a result, water flows via the full discharge outlets defined at the central area of said base plate into the space of said dispenser head and further is evenly discharged via said full discharge openings and all the sprinkling bores of said round board; as an external water flow is jetted against said dispenser head to clean dirt out of said, water can flush dirt directly into said closed area of said dispenser head and further via said full discharge outlets and into said sprinkler gun and finally out of said dispenser head via said evenly distributed full discharge openings.

* * * * *